US005509819A

United States Patent [19]

Stein, Sr. et al.

[11] Patent Number: 5,509,819

[45] Date of Patent: Apr. 23, 1996

[54] LOW PROFILE SPLICE BUSSING PLATE

[75] Inventors: William L. Stein, Sr., Warren, Ohio; Robert W. Rimko, Transfer, Pa.

[73] Assignee: General Motors Corporation, Detroit, Mich.

[21] Appl. No.: 287,555

[22] Filed: Aug. 8, 1994

[51] Int. Cl.[6] ..... H01R 31/08

[52] U.S. Cl. ..... 439/189; 439/510

[58] Field of Search ..... 439/510, 512, 439/513, 189, 151

[56] References Cited

U.S. PATENT DOCUMENTS

| | | | |
|---|---|---|---|
| 313,616 | 3/1885 | Platt . | |
| 1,266,575 | 5/1918 | Frank . | |
| 3,400,358 | 9/1968 | Byrnes et al. . | |
| 3,439,315 | 4/1969 | Hamel et al. . | |
| 3,713,072 | 1/1973 | Henschen et al. . | |
| 3,805,116 | 4/1974 | Nehmann . | |
| 3,845,456 | 10/1974 | Michaels . | |
| 4,221,456 | 9/1980 | Cairns et al. . | |
| 4,354,727 | 10/1982 | Brown . | |
| 4,553,802 | 11/1985 | Ruehl . | |
| 4,876,712 | 10/1989 | Brint et al. | 439/151 |
| 4,889,499 | 12/1989 | Sochor | 439/268 |
| 4,957,453 | 9/1990 | Owen | 439/422 |
| 4,992,062 | 2/1991 | Nakayama et al. | 439/621 |
| 5,046,972 | 9/1991 | Pass | 439/751 |
| 5,133,673 | 7/1992 | Dijkshoorn | 439/422 |
| 5,252,088 | 10/1993 | Morello et al. | 439/271 |

*Primary Examiner*—Neil Abrams
*Assistant Examiner*—Barry Matthew L. Standig
*Attorney, Agent, or Firm*—William A. Schuetz

[57] ABSTRACT

A low profile electrical bussing plate for electrically connecting a plurality of spaced pin terminals carried by an insulated housing of an electrical connector assembly, the housing having a planar face from which the terminals project and which is matable with an insulated housing or member for connection with the housing having an end face for engaging and holding the bussing plate against the planar end face of the housing when connected thereto. The bussing plate includes an elongated planar base plate having a plurality of spaced apart, generally rectangularly shaped openings, a plurality of spaced pairs of first and second arms integral with the base plate along its opposite elongated sides and located transversely of the openings and with the arms each being folded across the base plate toward each other and bent to provide arcuate portions which face one another. The first and second arms at the free ends terminated adjacent the plane containing the base and are deflectable when engaged by a pin terminal upon the latter being inserted therebetween to biasingly engage the pin terminals and the bussing plate having first and second sides respectively integral with the side edges of the openings and extending perpendicular to its base so as to straddle the first and second arms and align the pin terminals in the bussing plate.

6 Claims, 3 Drawing Sheets

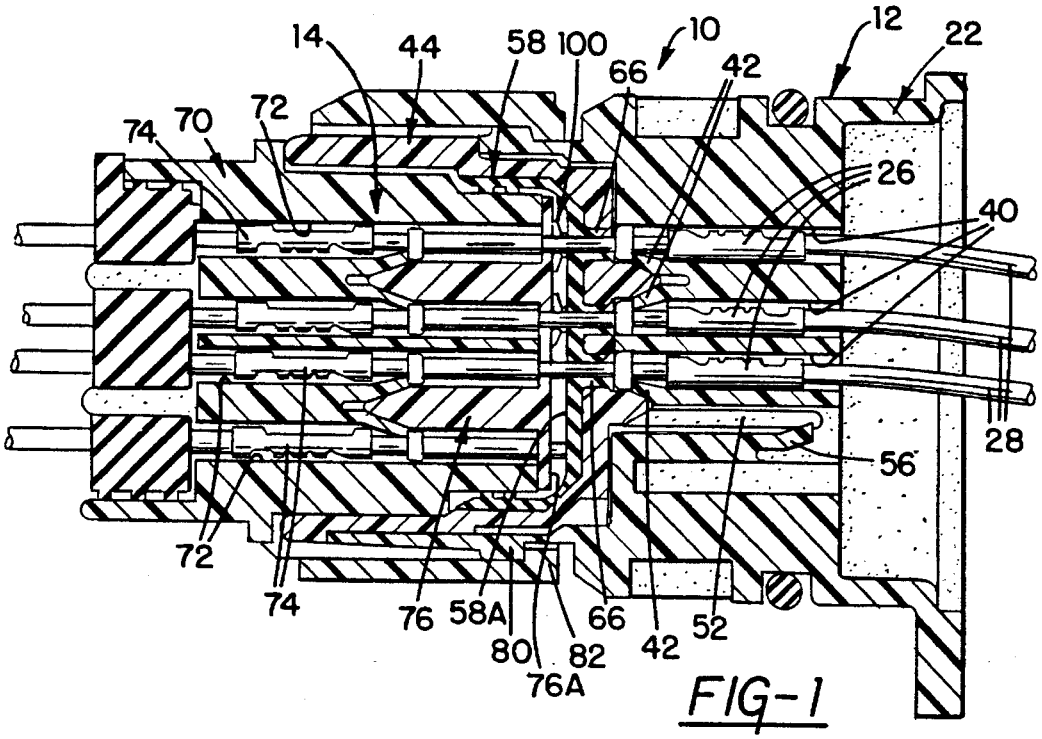
FIG-1
FIG-2
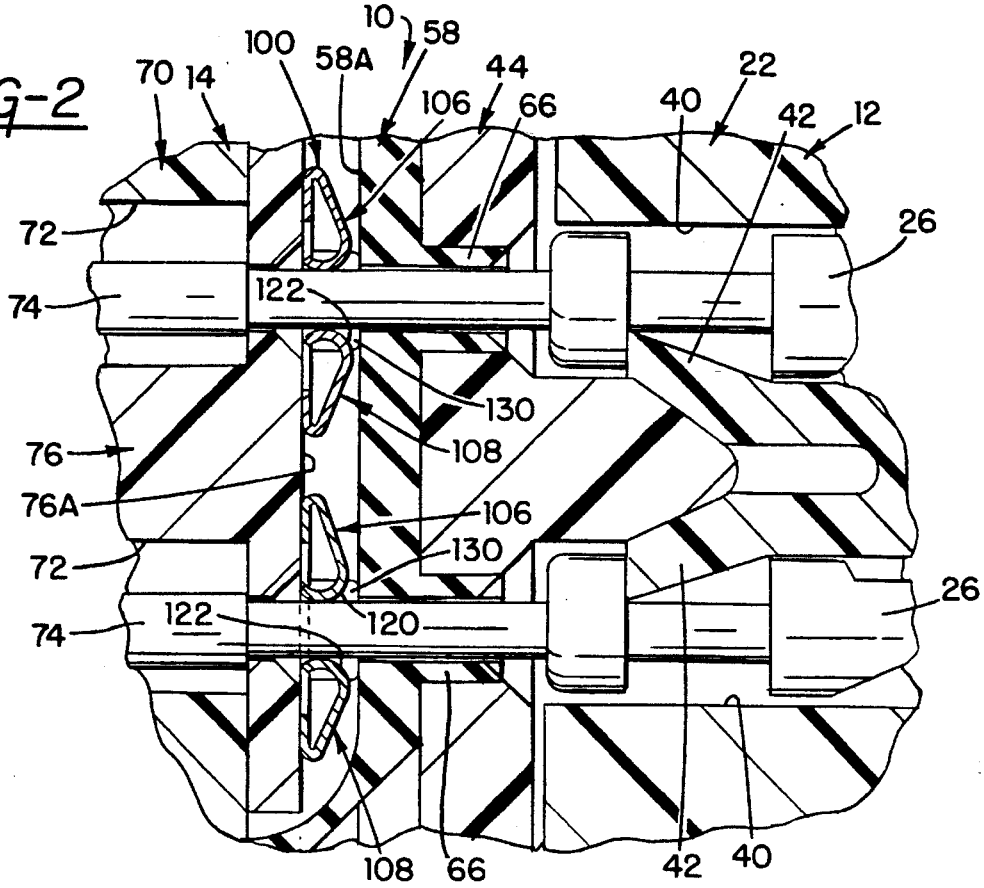

FIG-3
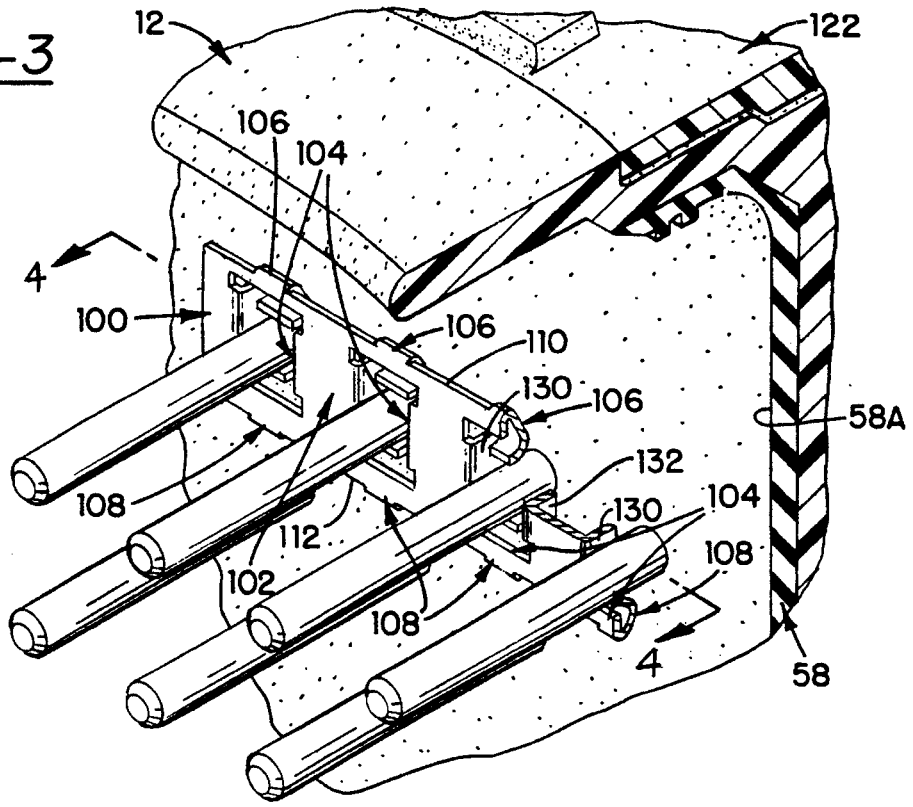
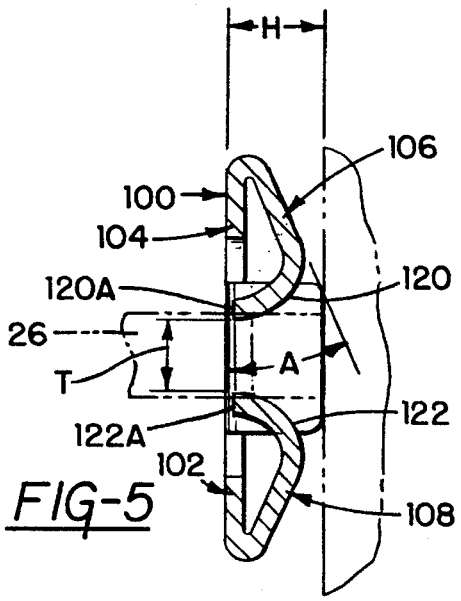
FIG-5
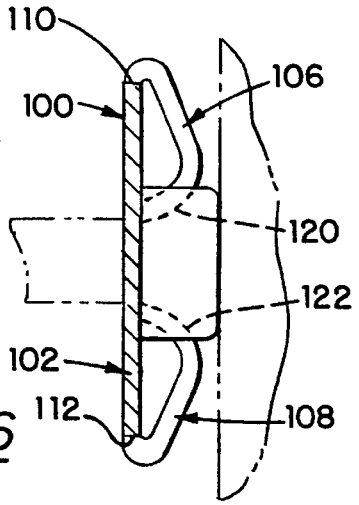
FIG-6

LOW PROFILE SPLICE BUSSING PLATE

The present invention relates to a low profile splice bussing plate for electrically connecting a plurality of pin terminals to each other and, more particularly, to a low profile bussing plate which can be readily attached to a plurality of pin terminals and held in place by being sandwiched between two insulated members of an electrical connector assembly when the members are connected together.

BACKGROUND OF THE INVENTION

One common type of electrical connector assembly comprises male and female connector housings or housing subassemblies, one of which carries a plurality of male pin terminals connected to conductor wires and the other of which carries a plurality of female cylindrical sockets or pin terminals connected to conductor wires. When the male and female housings or housing subassemblies are mated or connected together, the male pin terminals are received within the female socket terminals to provide an electrical connection therebetween.

It is also known that some of the conductor wires and terminals can be eliminated by employing bus bars or plates for electrically connecting a plurality of the terminals together. For example, an input terminal can be connected to a plurality of output terminals via a bus bar.

SUMMARY OF THE INVENTION

In accordance with the provisions of the present invention, a novel low profile splice bussing plane is provided for electrically interconnecting a plurality of pin or pin type terminals, and in which the bussing plate can be readily connected to the plurality of terminals and can be held in place on the terminals by being sandwiched between a first connector housing or member containing the pin terminals and a second connector housing or member upon the latter being connected to the first connector housing or member without the need for any other retention means.

The novel low profile bussing plate comprises an elongated planar base plate having a plurality of spaced apart, generally rectangularly shaped openings therethrough and with the openings being defined by opposed first and second side edges and opposed third and fourth side edges which face each other. The bussing plate further includes a plurality of spaced first and second arms respectively integral with the base plate along its opposite elongate sides at a location transversely of the first and second side edges of the openings, respectively. The first and second arms are folded across the base plate toward each other and are bent to provide arcuate portions which face each other and with their free ends terminating adjacent a plane containing the base plate and being spaced inwardly from their adjacent first or second side edges of the rectangular opening. The first and second arms are deflectable away from each other when a pin terminal is inserted therebetween to biasingly engage the pin terminals with a low engage force and the base plate has first and second upwardly bent sides integral with the third and fourth side edges of the openings and extending perpendicular thereto so as to straddle the first and second arms to aid in aligning the pin terminals to the bussing plate.

In addition, the first and second perpendicularly extending sides engage a planar end face of the associated connector member or housing to prevent direct contact between the contact arms and the connector members or housings when the bussing plate is attached to a plurality of pin terminals and held sandwiched between the first and second connector members or housings. This enables the arms to freely flex and engage the pin terminals.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which:

FIG. 1 is a longitudinal or axial sectional view of an electrical connector assembly embodying the novel bussing plate of the present invention;

FIG. 2 is an enlarged fragmentary cross sectional view of part of the novel connector assembly shown in FIG. 1;

FIG. 3 is a fragmentary perspective view of part of the electrical connector assembly shown in FIG. 1 and showing the bussing plate of the present invention connected to a plurality of male pin terminals;

FIG. 5 is an enlarged cross sectional view of the electrical bussing plate shown in FIG. 4, and taken approximately along line 5—5 of FIG. 4; and FIG. 6 is an enlarged cross sectional view taken approximately along line 6—6 of FIG. 4.

DETAILED DESCRIPTION OF THE PREFERRED EMBODIMENT

Figure 4:
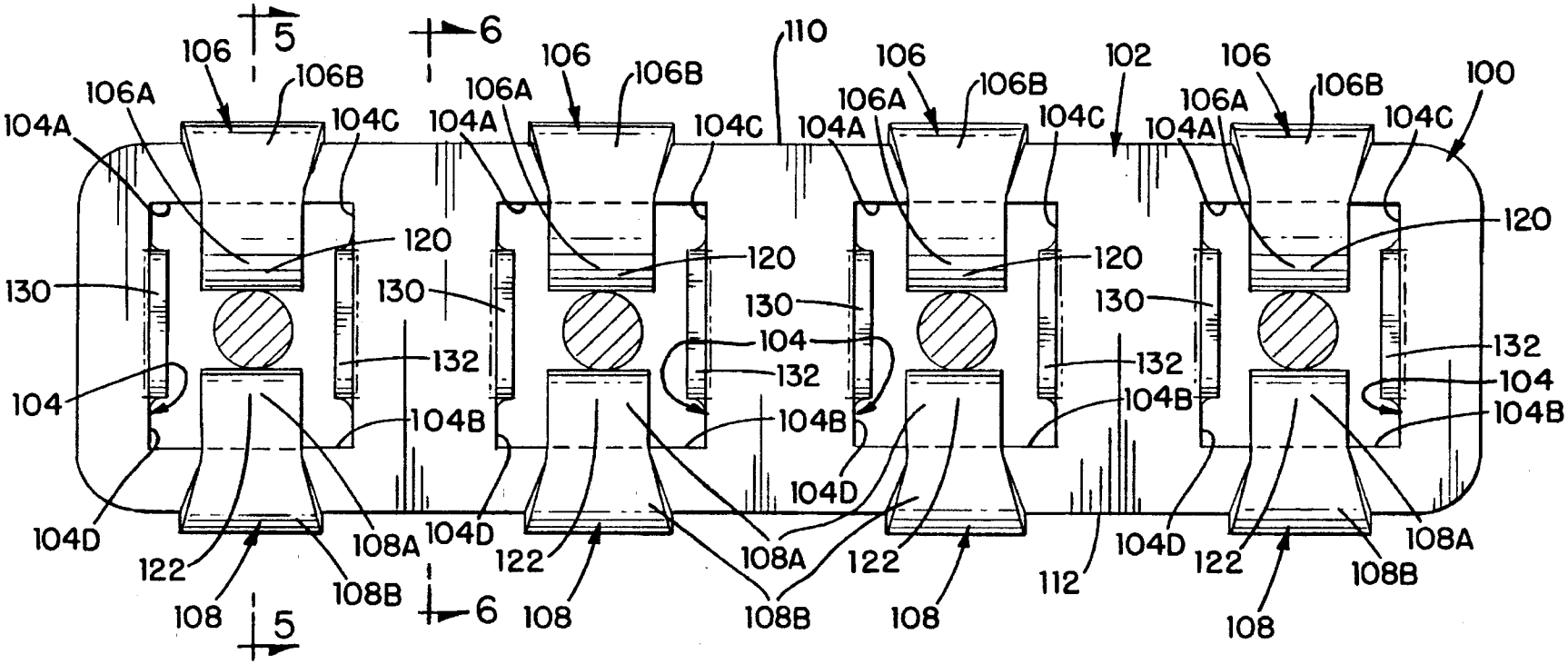
FIG. 4 is an enlarged cross sectional view taken approximately along line 4—4 of FIG. 3.

The present invention relates to a low profile splice bussing plate for electrically connecting a plurality of pin terminals to each other and which is adapted to be held in place by being sandwiched between two insulated members or housings of an electrical connector assembly when the latter are connected together. Although the novel low profile splice bussing plate could be used in any type of electrical connector assembly having a plurality of pin or pin type terminals, it is especially useful for splicing together a plurality of male pin terminals of an electrical connector assembly in which the splice bussing plate would be sandwiched between two mating housings or members of the electrical connector assembly. One such example of an electrical connector assembly is shown and described in U.S. Pat. No. 5,252,088, which is assigned to the same assignee as the present invention.

FIG. 1 of the drawings is the electrical connector assembly 10 shown in the aforementioned U.S. Pat. No. 5,252,088, but with the novel electrical bussing plate added thereto. For a detailed description of the electrical connector assembly 10 shown in FIG. 1, resort may be had to the aforementioned application 5,252,088 which is incorporated herein by reference. The electrical connector assembly 10 will be herein described only to the extent necessary for an understanding of the present invention and the relationship of the novel bussing plate to the connector assembly 10.

The electrical connector assembly 10 comprises a male connector assembly 12 and a female connector assembly 14. The male connector assembly 12 comprises a connector housing 22 having a plurality of apertures 40 extending therethrough for housing a plurality of two piece male pin terminals 26. The male terminals 26 are arranged in rows and are suitably crimped onto conductor wires 28. Although the male pin terminals 26 could be of any suitable cross-sectional shape, they are preferably cylindrical in shape. The male pin terminals 26 are retained within the cavities 40 by deflectable latch fingers 42 integral with the housing 22. The male connector assembly 12 also includes an insert 44 which is cup shaped and is adapted to be received within a forward portion of the housing 22 and is connected thereto via rearwardly extending legs or posts 52 which are snap fittingly connected to the housing 22 via tangs 56 integral with the housing 22. The insert 44 includes a seal 58 having a plurality of buttons 66 through which the male pin terminals 26 extend and which sealingly engage the male pin terminals. The seal 58 has a planar outwardly facing end surface 58A through which the cylindrical pin terminals 26 extend. The terminals 26 could be of any suitable or conventional construction and, preferably, are of the type disclosed in the aforementioned U.S. Pat. No. 5,252,088.

The female connector 14 comprises a suitable housing member 70 having a plurality of cavities 72 therethrough for retaining a plurality of female cylindrically shaped socket terminals 74 therein. The female terminal includes an end insert 76 for retaining the socket terminals 74 in place and for assuring their proper position within female housing 14. The insert 76 is adapted to be suitably connected to the male housing member 70 and has a planar end face 76A. The female housing member 70 is connected to the male housing member 22 by inserting its forward end into the cup shaped insert 44 of the male connector assembly 12 until suitable latch and catch members 80, 82 on the respective housings 22, 70 are latched together.

In accordance with the provisions of the present invention, a low profile, one piece splice bussing plate 100 is provided to electrically connect or splice together the male pin terminals 26 in some of the rows of the pin terminals 26. The number of bussing plates 100 which are employed can be varied depending on the use and application of the connector assembly 10. The bussing plate 100 is suitably stamped from flat sheet metal stock, such as brass, aluminum or brass coated steel, and bent to the configuration shown in FIGS. 3–6. The low profile bussing plate 100 comprises a flat or planar elongated, rectangularly shaped base plate 102 having a plurality of longitudinally spaced, rectangularly shaped openings 104, hereshown as four openings, extending therethrough. The openings 104 are defined by opposed side walls 104A and 104B and opposed end walls 104C and 104D.

The bussing plate 100 also includes four pairs of longitudinally spaced apart first and second arms 106, 108 which are integrally connected with the bus plate base 102 at its opposite elongated sides or side edges 110, 112, respectively. The arms 106, 108 are laterally or transversely spaced from the sides 104B, 104A, respectively, and are spaced equidistant from the sides 104C and 104D of the openings 104.

The arms 106, 108 are initially flat when stamped out so as to extend outwardly from the sides 110, 112. They are then bent and folded across the base plate 102 and toward one another, as best shown in FIGS. 4–6. The arms 106, 108 are bent so as to form an acute included angle A with the base plate 102, as shown in FIG. 5, and are bent so as to have arcuate or curved surfaces 120, 122 which face one another. The arms 106, 108 are thus folded across the base plate 102 and then curved downwardly to provide the curved surfaces 120, 122 which face one another. The arms 106, 108 and have free ends 122A, 120A which terminate in the plane of the base plate 102, as viewed in FIG. 5. The arms 106, 108 at their free end portions 106A, 108A have a width which is less than the width of the arms 106, 108 along their portions 106B, 108B adjacent the side edges 110, 112. The width of the arm portions 108B, 106B progressively decrease from their adjacent side edges 110, 112 toward their free end portions 106A, 108A. This renders the end portions 106A, 108A more flexible than the portions 106B, 108B adjacent the side edges 110, 112 of the base 102.

The arms 106, 108 at their free ends 120A, 122A are spaced apart to have a width T which is less than the nominal diameter of the male pin terminals 26 which they are to be mated to so that when the pin terminal is inserted between the arms 106, 108, the arms will be deflected away from each other to biasingly engage the opposite diametrical portions of the pin terminals 26 with a predetermined engaged force.

The bussing plate 100 also includes a pair of sides 130, 132 which are integral with the side edge 104C, 104D of each of the openings 104. The sides 130, 132 are bent upwardly out of the plane of the opening 104 and extend perpendicularly to the base 102 and straddle the transversely bent arms 106, 108. The sides 130, 132 have a height H which is higher than the height H' of the bent arms at their greatest distance from the plane of the base 102, and for reasons to be hereinafter described. The sides 130, 132, which straddle the arms 106, 108 serve to help align the bussing plate 100 to the male pin terminals when attached to ensure the male pin terminals are perpendicular to the base 102.

As can be seen from FIG. 3, the bussing plate 100 is attached to a row of male pin terminals 26 of the male connector subassembly 12 by aligning the arms 106, 108 of the bussing plate 100 with the male pin terminals 26. The bussing plate 100 is aligned by facing the same with the curved surfaces 120, 122 of the arms facing the pin terminal 26. The bussing plate is then pushed over the male pin terminals 26 and with the curved portions 120, 122 of the arms 106, 108 engaging the male terminals to cause the arms 106, 108 to be deflected from their normal free state position away from each other to biasingly engage the male pin terminals 26 to provide for a good electrical connection therebetween. The shape of the curved arms 106, 108 is such that they provide good electrical contact while at the same time requiring only a low engage force.

The bussing plate 100 is pushed over the male pin terminals until the sides 130, 132 at their planar ends engage the end face 58A of the seal 58 of the connector assembly 12. This engagement between sides 130, 132 and the seal 58 provides a spacing such that the arms 106, 108 do not touch or engage the planar seal 58 so that they are free to flex and so that they cannot be disengaged from the male pin terminals 26.

After the bussing plate 100 is positioned onto the connector subassembly 12, the female connector subassembly 14 can be attached to the connector subassembly 12 and with the end face 76A of the forward portion of the insert 76 engaging the back side or the base 102 of the bussing plate to hold the same sandwiched between the connector assemblies 12, 14.

The bussing plate 100 serves to provide a splice between the input male pin terminals 26 of a row of terminals without the need for all of the terminals being matable with the mating female connector. A current could come in, for example, by one of the female terminals connected to one of the male terminals in the row containing the bussing plate.

From the foregoing, it should be apparent that a novel, simple, low cost bussing plate has been provided which can be readily attached to a plurality of male terminals and held in place by being sandwiched between a pair of connector housings or members. The bussing plate includes sides for aligning the terminals and for preventing the bussing plate from being squeezed between the connector housings or members to a point where disengagement between the male pin terminals and the spring contact arms could take place.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A low profile electrical bussing plate for electrically connecting at least one input pin terminal to a plurality of output pin terminals comprising:

an elongated planar base plate having a plurality of spaced apart, generally rectangularly shaped openings therethrough, said opening being defined by opposed first and second side edges and opposed third and fourth side edges which face each other, respectively, a plurality of spaced first and second arms respectively integral with said base plate along its opposite elongated sides and located transversely of said first and second side edges of said openings, respectively, said first and second arms being folded across said base plate toward each other and bent to provide arcuate portions which face each other, said first and second arms at their free ends terminating adjacent a plane containing the base plate and being spaced inwardly from their adjacent first and second side edge of the rectangular opening, said first and second arms being spaced from each a transverse distance which is less than the maximum transverse dimension of the pin terminals, said arms being deflectable away from each other when a pin terminal is inserted therebetween to biasingly engage the pin terminals with a low terminal engage force, and first and second sides respectively integral with said third and fourth side edges of said openings and extending perpendicularly to said base plate so as to straddle said first and second arms to aid in aligning said pin terminals to said bussing plate.

2. A low profile electrical bussing plate, as defined in claim 1, and wherein said sides have a height which is higher than said first and second arms as measured from said plane of said base plate.

3. A low profile electrical bussing plate, as defined in claims 1 or 2, and wherein said first and second arms each have first portions integral with said base plate and second curved portions terminating in said free ends, said second portions of said first and second arms having a width which is less than said first portions.

4. A low profile electrical bussing plate for electrically connecting a plurality of spaced pin terminals having a given diameter carried by an insulated housing of an electrical connector assembly, said housing having a planar face from which the pin terminals project and said connector assembly including a second insulated member for connection with said housing and having an end face for engaging and holding said bussing plate against said planar face of said housing when connected to the housing, said bussing plate comprising:

an elongated planar base plate having a plurality of spaced apart, generally rectangularly shaped openings therethrough, said opening being defined by opposed first and second side edges and opposed third and fourth side edges which face each other, respectively, a plurality of spaced pairs of first and second arms integral with said base plate along its opposite elongated sides and located transversely of said first and second side edges of said openings, respectively, said first and second arms of each pair of arms being folded across said base plate toward each other and bent to provide arcuate portions which face each other, said first and second arms of each pair of arms at their free ends terminating adjacent a plane containing the base plate and being spaced inwardly from their adjacent first or second side edges of the rectangular opening, said first and second arms of each pair of arms being spaced a transverse distance from each other which is less than the given diameter of said pins, said arms being deflectable away from each other when the pin terminals are inserted therebetween to biasingly engage the pin terminals with a low terminal engage force, and first and second sides respectively integral with said third and fourth side edges of said openings and extending perpendicularly to said base plate so as to straddle said first and second arms to aid in aligning said pin terminals to said bussing plate, said first and second sides having a height which is higher than said first and second arms as measured from the plane of said base plate, said first and second sides being abuttingly engageable with said planar face of said housing when the second insulating member engages said base plate and is connected to said housing whereby said first and second arms of each pair of arms are unrestrained by being free from engagement with said insulated housing.

5. A low profile electrical bussing plate as defined in claim 4 and wherein the free ends of said first and second arms of each pair of arms does not extend through its associated opening in said base plate.

6. A low profile electrical bussing plate as defined in claim 5 and wherein said free ends of said first and second arms of each pair of arms lies in the plane of said base plate.

* * * * *